US006120364A

United States Patent [19]

Laflamme

[11] Patent Number: 6,120,364

[45] Date of Patent: Sep. 19, 2000

[54] GRINDING FIXTURE AND ASSEMBLY

[76] Inventor: Robert Laflamme, R.R. 3 Box 90C, Laconia, N.H. 03246

[21] Appl. No.: 09/347,770

[22] Filed: Jul. 6, 1999

Related U.S. Application Data

[60] Provisional application No. 60/091,863, Jul. 6, 1998.

[51] Int. Cl.[7] ..... B43B 19/00

[52] U.S. Cl. ..... 451/380; 451/387; 451/220; 451/222; 451/918; 269/58; 269/71

[58] Field of Search ..... 451/28, 11, 380, 451/387, 220, 222, 918; 269/55, 58, 71, 901

[56] References Cited

U.S. PATENT DOCUMENTS

| | | | |
|---|---|---|---|
| 2,365,436 | 12/1944 | Saucier | 269/69 |
| 4,157,635 | 6/1979 | Ward | 451/220 |
| 4,718,203 | 1/1988 | Schweitz et al. | 451/44 |
| 4,936,173 | 6/1990 | New | 82/18 |
| 5,651,722 | 7/1997 | Werner | 451/28 |
| 5,737,057 | 4/1998 | Kojima et al. | 351/177 |
| 5,738,564 | 4/1998 | Helle et al. | 451/11 |

*Primary Examiner*—Stephen F. Gerrity
*Assistant Examiner*—Rhonda E Sands
*Attorney, Agent, or Firm*—Michael J. Persson; Lawson, Philpot & Persson, P.C.

[57] ABSTRACT

A grinding fixture that allows a variety of helical shapes to be ground upon a variety of cutting inserts. The grinding fixture includes a bottom sine base for varying a first angle. A shaft is rotatably attached to the bottom sine base for providing rotation of the insert about an axis. A primary slide is rotatably attached to the shalt in parallel relation to the top surface of the bottom sine base for adjusting the position of a locating point on the insert in a first direction relative to the axis of rotation. The locating point is adjusted in a second direction relative to the axis of rotation by a cross slide attached to, and disposed in perpendicular relation with, the primary slide. A top sine assembly is fixedly attached to the cross slide for varying a second angle and includes a connection surface for fixedly connecting the insert holder to the sine assembly.

20 Claims, 6 Drawing Sheets

GRINDING FIXTURE AND ASSEMBLY

CLAIM OF PRIORITY

This patent application claims the benefit of priority of U.S. Provisional Patent Application Serial No. 60/091,863, filed Jul. 6, 1998.

FIELD OF THE INVENTION

The present invention relates to the field of grinding fixtures and, in particular, to grinding fixtures and assemblies for grinding helical shapes upon cutting tool inserts.

BACKGROUND OF THE INVENTION

Cutting tools having helical cutting edge s have been utilized for many years. Though the most common of these tools is the helical drill, helical edges have also been disposed upon other cutting tools, such as milling, grooving, and other cutting inserts, in order to take advantage of the increased cutting surface that a helical edge provides.

A helix is defined as a three-dimensional curve that lies on a cylinder or cone such that its angle to a plane perpendicular to the axis of the cylinder or cone is constant. When applied to a cutting insert, a helix is a function of the start angle at the point along the edge that the helix begins, the helical radius, the length of the arc through which the helix travels, and the finish angle at the point along the edge that the helix ends. Because of the three dimensional nature of a helical edge, conventional two dimensional grinding techniques have not been readily suited for producing helical edges on cutting inserts.

The problem of grinding a three dimensional form on a surface is readily solved by utilizing a computer numerically controlled (CNC) grinder. To grind such a surface utilizing a CNC grinder, one needs to program the travel of the grinder relative to the stationary workpiece, fixture the workpelace within the grinder, and allow the grinding wheel to travel through the preprogrammed helical arc to produce the desired helical surface. However, the application of a CNC grinder to solve the helical grinding problem is not without its drawbacks. First, CNC grinders are very expensive, currently costing between one hundred and fifty and two hundred and fifty thousand dollars. Second, CNC grinders require skilled programmers to program the correct surface equations to yield the desired helical surface. Finally, CN(C grinders are expensive to maintain and run due to their heavy reliance on electronics. Thus, there is a need for a way to grind a helical edge on a cutting insert that is relatively inexpensive to manufacture, does not require the services of skilled programmers to produce a helical edge, and that is relatively inexpensive to maintain and run.

Another method of producing a helical edge on a cutting insert involves the use of a grinding fixture having a specially formed cam to move the workpiece through the predetermined helical arc relative to a stationary grinding wheel to provide the desired helical surface. Such cam guided grinding fixtures are common in the field of helical drill sharpening and are readily adaptable to grinding helical surfaces on cutting inserts. Such a fixture would be relatively inexpensive to manufacture, would not require the services of a skilled programmer to provide the helical edge and would be relatively inexpensive to maintain and run. However, because specially formed cams are utilized in these fixtures, each fixture may only be used to grind a specific helix oil a specific insert. Because of their insert specific nature, cam guided fixtures are undesirable in situations where a variety of inserts and/or helical surfaces is to be ground. In addition, the rotational way in which a cam guided fixture transfers the cam shape to the insert precludes the use of such fixtures on inserts requiring the grinding of compound shapes. Because of this preclusion, such fixtures are not suitable for use with inserts having chamfers, flats or non-rotationial angular surfaces that interact with the helical surface to form such a compound shape. Therefore, there is a need for a way to grind a helical edge on a cutting insert that may be readily adapted to grinding a variety of helical surfaces on a variety of cutting inserts and is adapted to grind compound surfaces having at least one helical surface as a component.

An apparatus for grinding a helical edge on a cutting insert that is relatively inexpensive to manufacture that does not require the services of skilled programmers, that is relatively inexpensive to maintain and run. that may be readily adapted to grinding a variety of helical surfaces on a variety of cutting inserts, and is adapted to grind compound surfaces having at least one helical surface as a component, is not known in the art.

SUMMARY OF THE INVENTION

The present invention is a grinding fixture that allows a variety of helical shapes to be ground upon a variety of cutting inserts. In its most basic form, the grinding fixture of the present invention includes a bottom sine base for varying a first angle. A shaft is rotatably attached to the bottom sine base for providing rotation of the insert about an axis. A primary slide is rotatably attached to the shaft in parallel relation to the top surface of the bottom sine base for adjusting the position of a locating point on the insert in a first direction relative to the axis of rotation. The locating point is adjusted in a second direction relative to the axis of rotation by a cross slide attached to, and disposed in perpendicular relation with, the primary slide. A top sine assembly is fixedly attached to the cross slide for varying a second angle and includes a connection surface for fixedly connecting the insert holder to the sine assembly.

To operate the grinding fixture an insert is first secured within the insert holder. Once secured, the bottom sine base is adjusted to provide a desired first angle A, and the top sine assembly is adjusted to provide a desired second angle B relative to the first angle A. The center of rotation R of the shaft is then aligned a predetermined distance from the grinding surface of the grinding wheel; preferably the front face of the wheel. This distance between the center of rotation R and the grinding surface of the wheel is the helical radius of the grind and will remain constant throughout the travel of the insert. Once the helical radius has been set, the primary and cross slides are adjusted to move the insert relative to the wheel. This ability to move the insert in two directions while maintaining a helical radius allows the amount and location of material to be removed from the insert to be varied while providing a constant helical radius. Once adjusted, the insert is rotated through a predetermined arc relative to the bottom sine base to grind the desired helical shape on the insert. Because of the near infinite variability of the helical radius. Angle A, and angle B, a near infinite variety of helical shapes may be ground.

In the preferred embodiment of the invention, a sixth axis of adjustment is added to the fixture such that the center of rotation of the insert may be offset alone the axis of the cross slide. This offset feature is preferably a gear and rack assembly that offsets the location point of the insert a predetermined distance from the center of rotation of the shaft to a second location point on the insert. The addition of this sixth axis allows parallel edges of an insert to be aground with inverse helical shapes without removing and indexing the insert in the holder. In addition, by setting a second set of stops in different locations, the offset feature allows asymmetrical edge shapes to be ground as well, again without removing the insert from the holder.

In an alternate embodiment of the invention, an air drive system is employed to cause the required rotation through the use of a standard rotary actuator. An air system controller provides the correct pneumatic sequence and is used to activate the rotary actuator and is used to control an air cylinder, which drives the grinder table in a longitudinal direction as required to inject the fixture into contact with the grinding wheel or remove the fixture from the wheel contact point.

In another alternate embodiment, the air drive system is replaced with an electronic drive system. The electronic drive system includes a stepper motor that is attached to, and adapted to rotate, the shaft. An electronic controller is in electrical communication with the stepper motor and controls the movement of the shaft by the stepper motor. In some embodiments, the electronic controller is also attached to an electronic actuator for driving the grinder table in a longitudinal direction, as required to inject the fixture into contact with the grinding wheel or remove the fixture from the wheel contact point.

Therefore, it is an aspect of the invention to provide an apparatus for grinding a helical edge on a cutting insert that is relatively inexpensive to manufacture.

It is a further aspect of the invention to provide an apparatus for grinding a helical edge on a cutting insert that does not require the services of skilled programmers to produce a helical edge.

It is a further aspect of the invention to provide an apparatus for grinding a helical edge on a cutting insert that is relatively inexpensive to maintain and run.

It is a further aspect of the invention to provide an apparatus for grinding a helical edge on a cutting insert that may be readily adapted to grinding a variety of helical surfaces on a variety of cutting inserts.

It is a still further aspect of the invention to provide an apparatus for grinding a helical edge on a cutting insert that is adapted to grind compound surfaces having at least one helical surface as a component.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 1:
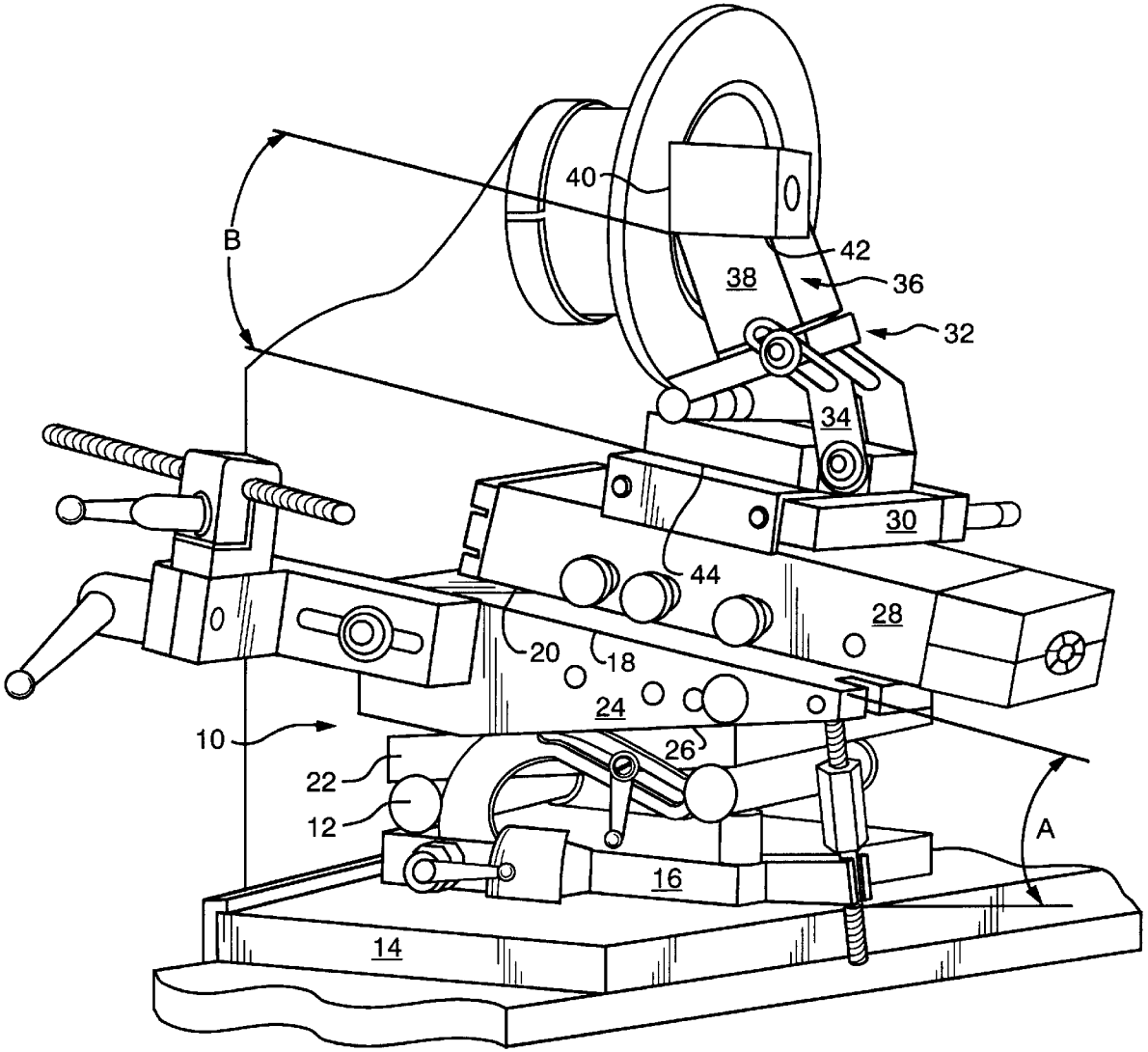
FIG. 1 is an isometric view of the basic embodiment of the grinding fixture of the present invention.

Referring first the FIG. 1, an isometric view of one embodiment of the grinding fixture of the present invention is shown. Grinding fixture 10 includes five movable components that produce four axes of adjustment and one axis of rotation of the grinding fixture 10. The combination of the five grinding fixture axes with the three axes of movement on a standard table grinder allows a variety of compound and helical shapes to be ground upon inserts.

The first movable component of grinding fixture 10 is a bottom sine base 12 that is dimensioned for mounting on a grinder table 14. Bottom sine base 12 may take many forms, but in all cases includes a bottom surface 16 that mates with the grinder table 14, a top surface 18 into which a shaft 20 is rotatatably mounted and a mechanism for providing angular adjustment between the top surface 18 and bottom surface 16. In the embodiment shown in FIG. 1, bottom sine base 12 comprises a commercially available five inch sine base assembly 22 to which a base block 24 has been attached. In this embodiment, base block 24 includes an angled surface 26 and the top surface 18 through which shaft 20 is mounted. In the preferred embodiment, angled surface 26 is angled at an angle of substantially fifteen degrees relative to top surface 18. Top surface 18 is adjusted by adjusting the commercially available sine base assembly 22 such the first angle A, formed by the intersection of the planes created by the top surface 18 and bottom surface 16, may be set to a variety of predetermined first angles A. The first angle A is equal to the first angle in the helix equation and represents the first axis of adjustment of the fixture.

The second movable component of grinding fixture 10 is rotatable shaft 20. Shaft 20 extends in a substantially perpendicular direction from top surface 18 of bottom sine base 12 and rotatably joins the bottom sine base 12 to the primary slide 28. As discussed further with reference to FIG. 2, shaft 20 is adapted to provide rotation of the insert about a predetermined axis. Shaft 20 is preferably made rotatable by the use of bearings, such as roller bearings (not shown). However, other rotational mechanisms, such as journal bearings, air bearings, or the like, may be used in other embodiments to achieve similar results. Similarly, as discussed with reference to FIG. 5, shaft 20 may be attached to an electronically controlled drive mechanism to automate the rotational component of the process. Shaft 20 provides the only "active" axis on this embodiment of the grinding fixture 10; i.e. once properly adjusted, the rotation of the shaft 20 provides the only movement of the insert by the grinding fixture 10 during grinding.

The third movable component of grinding fixture 10 is the primary slide 28. Primary slide 28 is rotatably attached to the shaft 20 such that it is disposed in substantially parallel relation to the top surface 18 of the bottom sine base 12. As discussed further with reference to FIG. 2, primary slide 28 is adapted for adjusting the position of a locating point on the insert in a first direction relative to the grinding surface of the grinding wheel. In the embodiment of FIG. 1. The primary slide 28 includes bottom details (not shown) that allow the primary slide 28 to move relative to the shaft 28 and a micromneter screw (not shown) that passes through the shaft 20 and allows the position of the primary slide 28 relative to the shaft 20 to be incrementally adjusted.

However, an electronically controlled drive screw or chain linkage may be utilized to automate positioning of the primary slide 28. The axis of motion of the primary slide 28 relative to the grinding wheel represents the second axis of adjustment of the grinding fixture 10.

The fourth movable component of the grinding fixture 10 is the cross slide 30. Cross slide 30 is attached to, and disposed in perpendicular relation with, the primary slide 28. As discussed further with reference to FIG. 2, cross slide 30 is adapted for adjusting the position of a locating point on the insert in a second direction relative to the grinding surface of the grinding wheel. In the embodiment of FIG. 1, cross slide includes bottom details (not shown) that allow the cross slide 30 to move relative to the primary slide 28 and a micrometer screw (not shown) that allows the position of the cross slide 30 relative to the primary slide 28 to be incrementally adjusted. However, as was the case with the adjustment of the primary slide 28, adjustment of the cross slide 30 may also be made utilizing an electronically controlled drive screw or chain linkage to automate positioning of the cross slide 30. The axis of motion of the cross slide 30 relative to the primary slide 28 represents the third axis of adjustment of the grinding fixture 10.

The fifth and final movable component of the grinding fixture of FIG. 1 is the top sine assembly 32. The top sine assembly 32 is fixedly attached to the cross slide 30 and includes a top sine base 34 for varying a second angle, and an insert holder 36 for securing an insert in a predetermined position. In the embodiment of FIG. 1, the top sine base 34 is a two inch sine base that is secured to the cross slide 30 and the insert holder 36 is an angled block 38 secured to the top sine base 34 and a holder 40 removably attached to the angled block 38 to allow a variety of inserts and holders 40 to be utilized. The position of holder 40 is adjusted by adjusting the top sine base 34 such that a second angle B, formed by the intersection of the planes created by the mounting surface 42 of the angled block 38 and mounting surface 44 of the cross slide 30, may be set to a variety of predetermined second angles B. The second angle B is equal to the second angle in the helix equation and represents the fourth axis of adjustment of the grinding fixture 10.

In addition to the movable components the embodiment of FIG. 1 includes a pair of stops for limiting the length of the arc through which the insert is rotated. In the embodiment of FIG. 1, these stops are rotatable screw type travel stops (not shown) attached to the fixture at opposite points across the fixture to allow for the desired travel. However, in other embodiments, other commonly used stops may be substituted to achieve similar results.

Figure 2A:
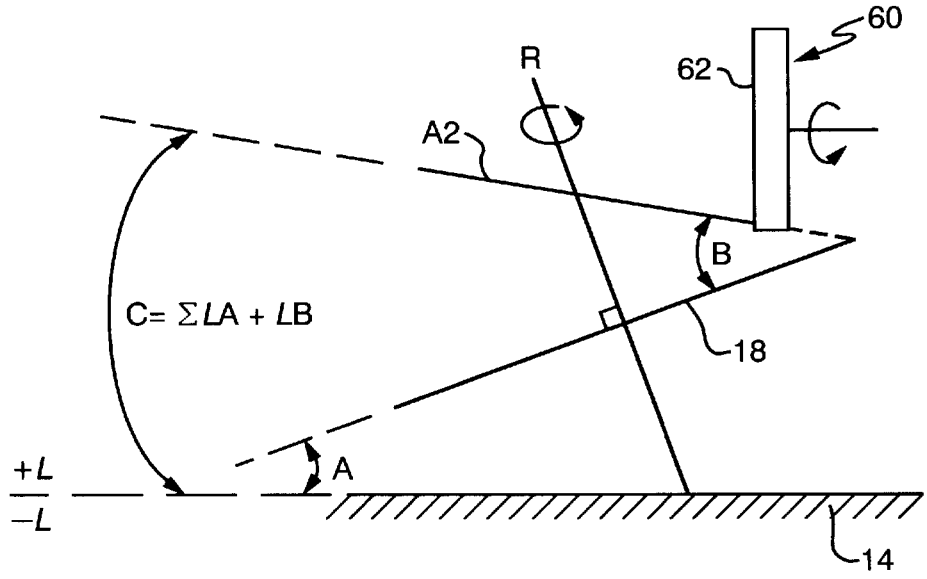
FIG. 2 is a diagram describing the axes of adjustment of the basic embodiment and the interaction between the axes of adjustment to yield the desired helical shape.
Figure 2B:
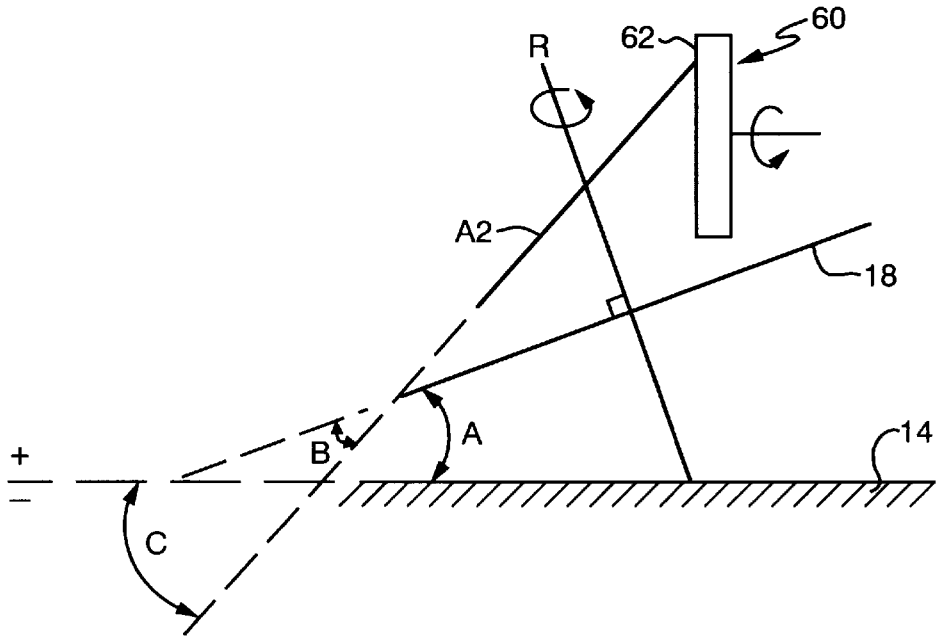

Referring now to FIGS. 2A and 2B, the operation of the fixture and interaction between the axes of angular adjustment and axis of rotation of the grinding fixture is discussed. To operate the grinding fixture, an insert is first secured within the insert holder. Once secured the bottom sine base is adjusted to provide a desired first angle A, and the top sine assembly is adjusted to provide a desired second angle 13 relative to the first angle A. The center of rotation R of the shaft is then aligned a predetermined distance from the grinding surface of the grinding wheel 60; preferably the front face 62 of the wheel. This distance between the center of rotation R and the grinding surface of the wheel is the helical radius of the grind and will remain constant throughout the travel of the insert. Once the helical radius has been set, the primary and cross slides are adjusted to move the insert relative to the wheel. This ability to move the insert in two directions while maintaining a helical radius allows the amount and location of material to be removed from the insert to be varied while providing a constant helical radius. Once adjusted, the insert is rotated through a predetermined arc relative to the bottom sine base to grind the desired helical shape on the insert.

FIGS. 2A & 2B show the relationship between the axis of rotation R of the shaft, the grinder table 14, the front face 62 of the grinding wheel 60, the plane formed by the top surface 18 of the bottom sine base and the plane formed by the mounting surface 42 of the top sine base. Grinder table 14 is always disposed in perpendicular relation with the front face 62 of the grinding wheel 60 and, thus, these are the reference planes for the system. As discussed above, the top surface 18 is disposed at an angle A from the plane of the grinder table 14 and in the same two dimensional plane as the grinder table 14 and front face 62 of the grinding wheel 62; i.e. an end view of the intersection of the planes would be a right triangle. The shaft extends in perpendicular relation from the top surface 18 and terminates in the top sine assembly, here represented by the plane created by the mounting surface 42 of the top sine base. The plane of the mounting surface extends at another angle B in relation to the plane of the top surface 18. Angle B represents the component of the angle of plane created by the mounting surface 42 that lies in the same plane as the top surface 18, grinder table 14 and front face 62 of the mounting wheel. FIGS. 2A and 2B show this relationship in two dimensional space. Once angle A is set, it remains constant and the angle of the insert with respect to the grinding table, and conversely to the front face 62 of the grinding wheel, is the sum of fixed angle A and the co-planar component 13 of the angle created by mounting surface 42. As the insert is rotated about the axis of rotation R the grind angle C between the edge of the insert to be ground and the front lace 62 of the grinding wheel 60 is constantly changing and is always equal to the sum of angles A and B. Grind angle C is shown as a positive angle in FIG. 2A and as a negative angle in FIG. 2B. Because of the near infinite variability of the helical radius angle A angle B, a near infinite variety of helical shapes may be ground .

Figure 3:
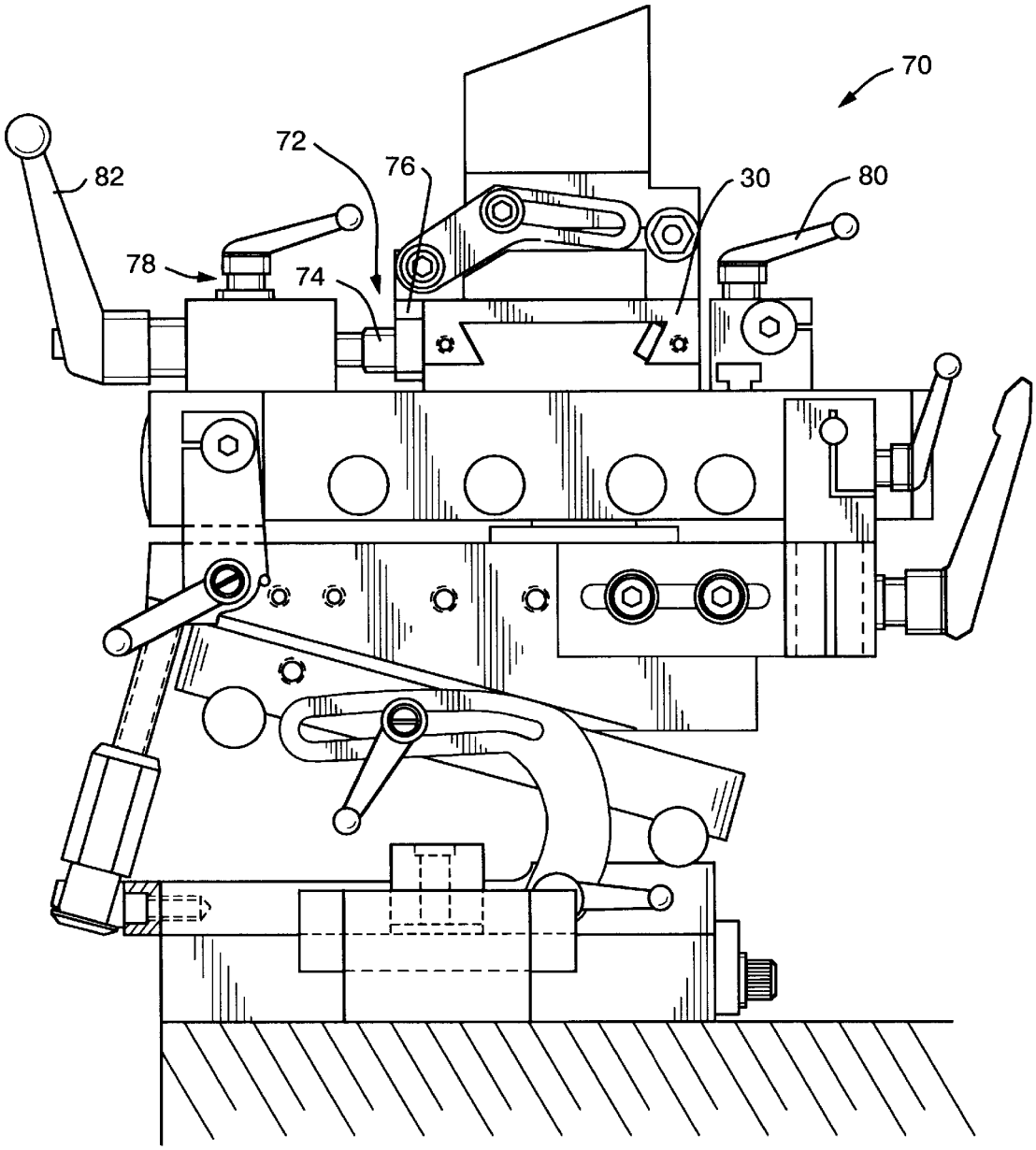
FIG. 3 is a side view of the preferred embodiment of the grinding fixture of the present invention utilizing an offset mechanism.
Figure 4:
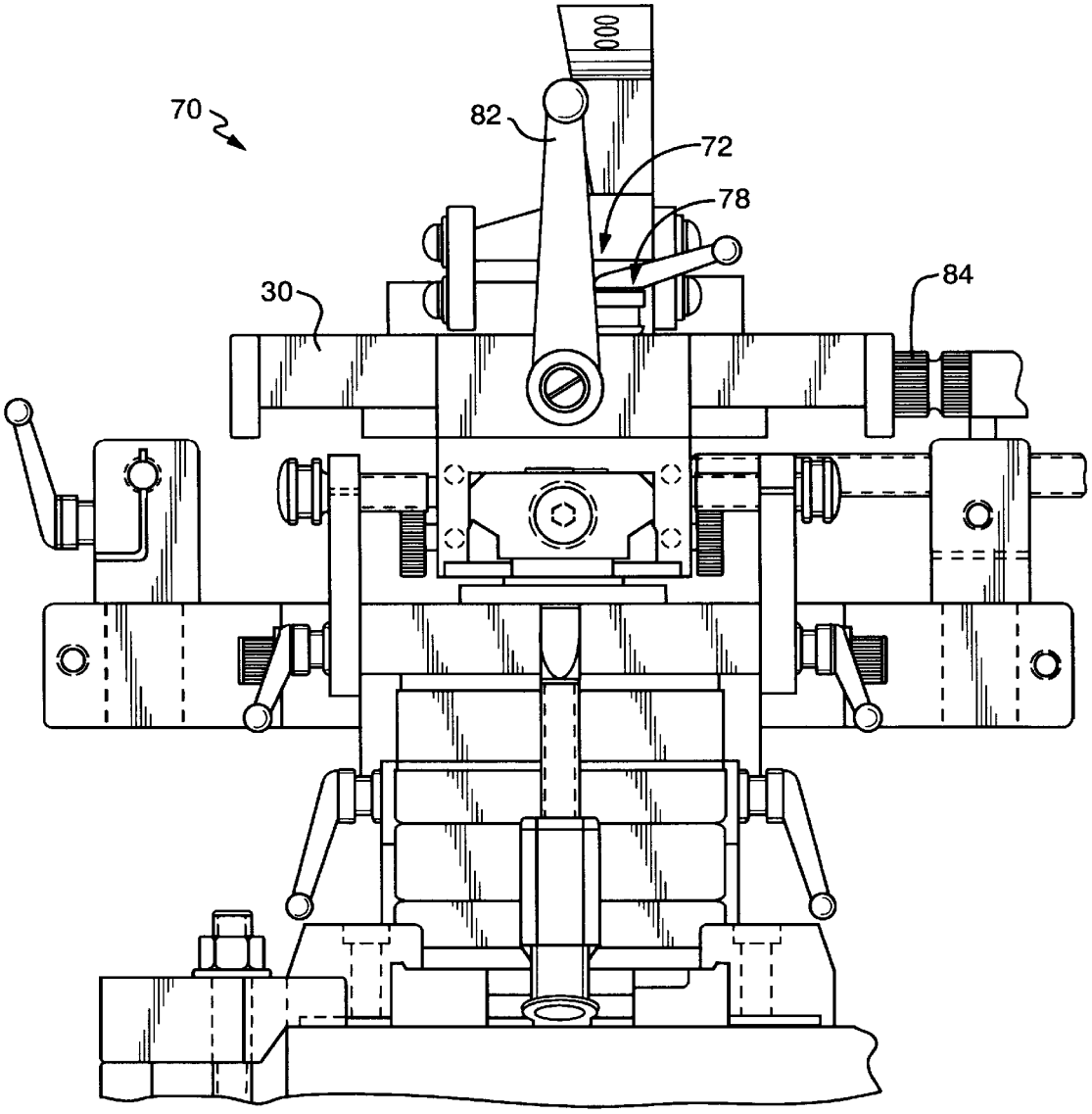
FIG. 4 is a front view of the preferred embodiment of the grinding fixture of the present invention utilizing an offset mechanism.
Figure 5:
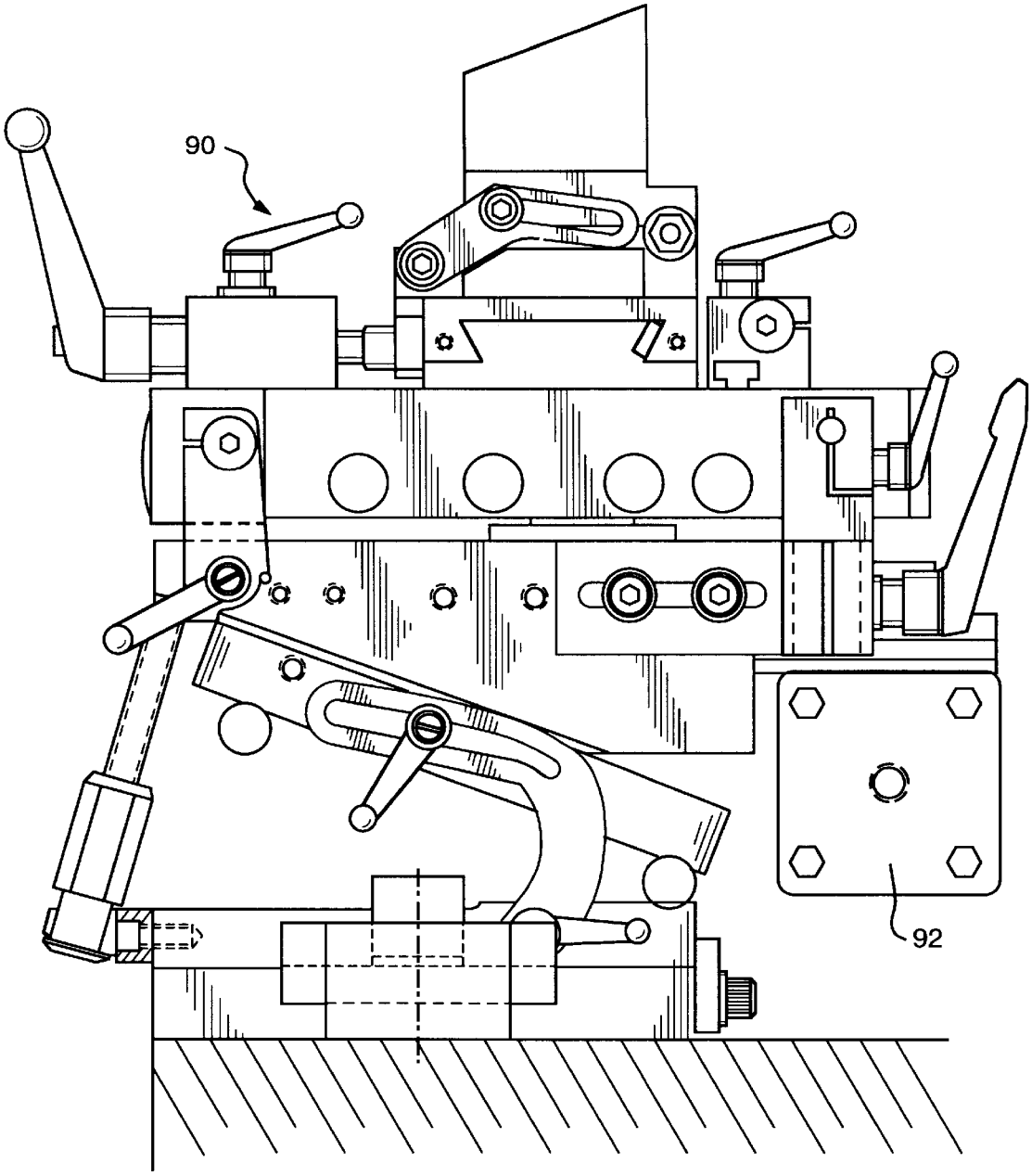
FIG. 5 is a side view of an alternate embodiment of the grinding fixture of the present invention utilizing an air drive system and the offset mechanism of FIGS. 3 & 4.

Referring now to FIGS. 3–5 the preferred grinding fixture 70 of the present invention is shown. The preferred grinding fixture 70 includes all of the features of the embodiment of FIG. 1, but also includes an offset mechanism 72 for offsetting the center of rotation of the insert relative to the wheel. This offset mechanism 72 provides a second active axis to the grinding fixture 70 and allows two edges of the insert to be ground without removing the insert from the holder or adjusting the cross-slide 30. The offset mechanism 72 includes a pinion 74 and rack 76 that act to move the cross slide rapidly from one set position to another when handle 82 is rotated. The micrometer screw 84 of the cross slide 30 is used to set stop assemblies 78 and 80 such that the travel of the cross slide is precisely limited. Once the stop assemblies 78 and 80 have been set, the micrometer screw 84 is disengaged from the cross slide allowing the offset mechanism 72 to provide all of the necessary motion of the cross slide 30.

Referring now to FIG. 5, an alternate embodiment of the grinding fixture is shown. The embodiment of FIG. 5 includes the offset assembly of FIGS. 3 & 4, but also employs an air drive system (not shown) to cause the required rotation through the use of a standard rotary actuator 92. An air system controller (not shown) provides the correct pneumatic sequence and is used to activate the rotary actuator. It is also used to control an air cylinder that drives the grinder table in a longitudinal direction as required to inject the fixture into contact with the grinding wheel or remove the fixture from the wheel contact point.

Figure 6:
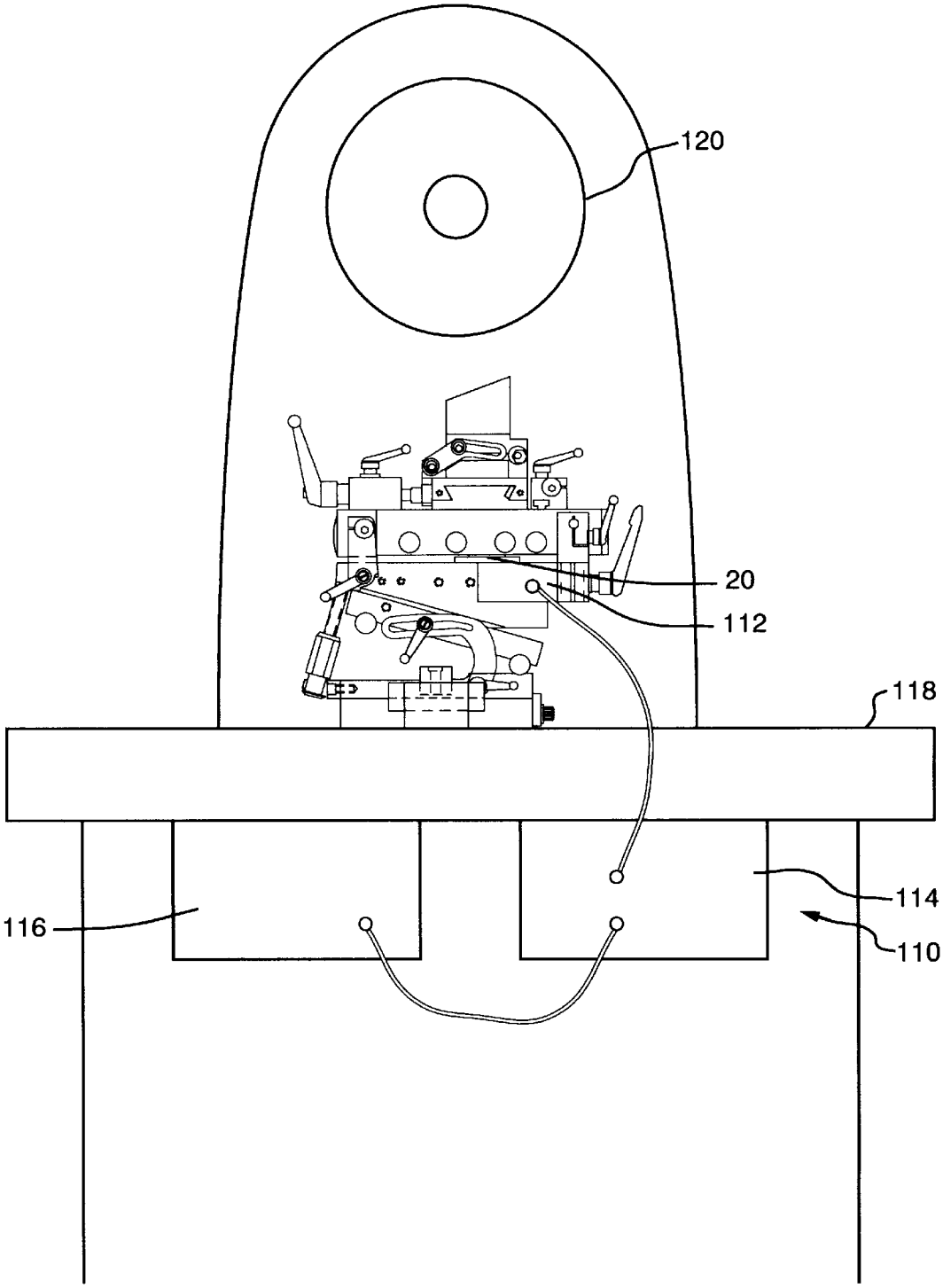
FIG. 6 is a block diagram of a grinding assembly utilizing the grinding fixture, a grinder, and an electronic control and drive system for automatically driving the grinding fixture and grinder.

Referring now to FIG. 6, another alternative embodiment of the grinding fixture is shown. In this embodiment, the air drive system of FIG. 5 is replaced with an electronic drive system 110. The electronic drive system 110 includes a stepper motor 112 that is attached to, and adapted to rotate, the shaft 20. An electronic controller 114 is in electrical communication with the stepper motor 112 and controls the movement of the shaft by the stepper motor 114. In some embodiments, the electronic controller 114 is also attached to an electronic actuator 116 for driving the grinder table 118 in a longitudinial direction, as required to inject the fixture into contact with the grinding wheel 120 or remove the fixture from the wheel contact point.

Although the present invention has been described in considerable detail with reference to certain preferred versions thereof, other versions would be readily apparent to those of ordinary skill in the art. For example, each of the axes of adjustment and axes of rotation may be automated utilizing readily available automation equipment. Similarly, in process gauging and other well-known automated quality control systems may also be utilized. Theretfore, the spirit and scope of the claims should not be limited to the description of the preferred versions contained herein.

What is claimed is:

1. A grinding fixture for grinding a cutting insert said grinding fixture comprising:

a bottom sine base for varying a first angle, said bottom sine base comprising a bottom surface dimensioned to mate with a grinder table, a top surface, and a mechanism for providing angular adjustment between said top surface and said bottom surface;

a shaft for providing rotation of the insert about an axis of rotation, said shaft being rotatably attached to, and extending in substantially perpendicular relation from, said top surface of said bottom sine base;

a primary slide for adjusting a position of a locating point on the insert in a first direction relative to said axis oft rotation, said primary slide being rotatably attached to said shaft in parallel relation to said top surface of the bottom sine base;

a cross slide for adjusting the locating point in a second direction relative to the axis of rotation, said cross slide being attached to and disposed in perpendicular relation with, said primary slide; and a top sine assembly slide for varying a second angle, said top sine assembly being fixedly attached to said cross slide and comprising a connection surface and an insert holder for securing said insert to said grinding fixture, said insert holder being fixedly connected to said connection surface of said top sine assembly;

wherein the insert is secured in the insert holder, the bottom sine base, top sine base, primary slide and cross slide are adjusted to predetermined positions, and the insert is rotated through a predetermined arc relative to said bottom sine base such that a helical shape is ground on the insert.

2. The grinding fixture as claimed in claim 1 wherein said bottom sine base further comprises a base block comprising an angled surface and said top surface of said bottom sine base.

3. The grinding fixture as claimed in claim 2 wherein said angled surface is disposed at an angle of about fifteen degrees relative to said top surface.

4. The grinding fixture as claimed in claim 1 further comprising a drive mechanism for controlling the rotation of said shaft about said axis of rotation.

5. The grinding fixture as claimed in claim 4 wherein said drive mechanism is an air drive system comprising a rotary actuator for rotating said shaft and an air system controller for controlling said rotary actuator.

6. The grinding fixture as claimed in claim 4 wherein said drive mechanism is a an electronic drive system comprising a stepping motor for rotating said shaft and an electronic controller for controlling said stepping motor.

7. The grinding fixture as claimed in claim 1 wherein said primary slide further comprises a micrometer screw for incrementally adjusting the position of the locating point on the insert in the first direction relative to said axis of rotation.

8. The grinding fixture as claimed in claim 1 wherein said primary slide further comprises an automatic positioning device for incrementally adjusting the position of the locating point on the insert in the first direction relative to said axis of rotation.

9. The grinding fixture as claimed in claim 1 wherein said cross slide further comprises a micrometer screw for incrementally adjusting the position of the locating point on the insert in the first direction relative to said axis of rotation.

10. The grinding fixture as claimed in claim 1 wherein said cross slide further comprises an automatic positioning device for incrementally adjusting the position of the locating point on the insert in the first direction relative to said axis of rotation.

11. The grinding fixture as claimed in claim 1 wherein said insert holder comprises a second angled block and a holder removably attached to said angled block.

12. The grinding fixture as claimed in claim 1 further comprising at least one stop for limiting said rotation of said insert about said axis of rotation.

13. The grinding fixture as claimed in claim 12 wherein said at least one stop is a rotatable screw travel stop.

14. The grinding fixture as claimed in claim 1 further comprising an offset mechanism for offsetting a center of rotation of said insert relative to a grinding wheel.

15. The grinding fixture as claimed in claim 14 wherein said offset mechanism comprises a pinion, a rack in communication with said pinion and a rotatable handle connected to said pinion and rack for actuating said pinion and rack such that center of rotation of said insert is offset.

16. A grinding assembly for grinding a helical shape upon a cutting insert, said assembly comprising:

a grinder comprising a grinding wheel and a grinder table, said grinding wheel being rotatable about a fixed axis, and said grinder table being adjustable in at least two directions; and a grinding fixture comprising:

a bottom sine base for varying a first angle, said bottom sine base comprising a bottom surface dimensioned to mate with the grinder table, a top surface, and a mechanism for providing angular adjustment between said top surface and said bottom surface;

a shaft for providing rotation of the insert about an axis of rotation, said shaft being rotatably attached to, and extending in substantially perpendicular relation from, said top surface of said bottom sine base;

a primary slide for adjusting a position of a locating point on the insert in a first direction relative to said axis of rotation, said primary slide being rotatably attached to said shaft in parallel relation to said top surface of the bottom sine base;

a cross slide for adjusting the locating point in a second direction relative to the axis of rotation, said cross slide being attached to, and disposed in perpendicular relation with said primary slide; and a top sine assembly slide for varying a second angle, said top sine assembly being fixedly attached to said cross slide and comprising a connection surface and an insert holder for securing said insert to said grinding fixture, said insert holder being fixedly connected to said connection surface of said top sine assembly;

wherein the insert is secured in the insert holder, the bottom sine base, top sine base, primary slide and cross slide are adjusted to predetermined positions, and the insert is rotated through a predetermined arc relative to said bottom sine base such that a helical shape is ground on the insert by said grinding wheel.

17. The assembly as claimed in claim 16 further comprising an air drive system comprising an air cylinder for driving said grinder table and an air system control for controlling said air cylinder.

18. The assembly as claimed in claim 17, wherein said air drive system further comprises a rotary actuator for rotating said shaft, said rotary actuator being in fluid communication with, and controlled by, said air system control.

19. The assembly as claimed in claim 16, wherein said grinder further comprises an electronic drive system comprising an electronic actuator for driving said grinder table and an electronic control for controlling said electronic actuator.

20. The assembly as claimed in claim 19 wherein said electronic drive system further comprises a stepping motor for rotating said shaft, said stepping motor being in electrical communication with, and controlled by, said electronic control.

* * * * *